US005282960A

United States Patent [19]

Pillon et al.

[11] Patent Number: 5,282,960

[45] Date of Patent: Feb. 1, 1994

[54] METHOD FOR IMPROVING THE DEMULSIBILITY OF BASE OILS

[75] Inventors: Liliana Z. Pillon, Sarnia; Andre E. Asselin, Forest, both of Canada

[73] Assignee: Exxon Research and Engineering Company, Florham Park, N.J.

[21] Appl. No.: 769,699

[22] Filed: Oct. 2, 1991

[51] Int. Cl.[5] ..... C10G 25/02; C10G 71/00; B01D 15/04

[52] U.S. Cl. ..... 208/299; 208/18; 210/689

[58] Field of Search ..... 208/299, 18, 188, 187, 208/310 R; 210/689

[56] References Cited

U.S. PATENT DOCUMENTS

| | | | |
|---|---|---|---|
| 1,772,985 | 8/1930 | Culmer | 208/287 |
| 2,034,712 | 3/1936 | Dolbear | 196/36 |
| 2,155,704 | 4/1939 | Goodall et al. | 210/689 |
| 2,356,890 | 8/1944 | Schulze | 196/4 |
| 2,548,502 | 4/1951 | Small | 183/114.2 |
| 2,754,343 | 7/1956 | Maisel | 260/674 |
| 2,756,197 | 7/1956 | Thorpe et al. | 208/18 |
| 3,272,742 | 9/1966 | Polishuk | 208/188 |
| 3,367,862 | 2/1968 | Mason et al. | 208/243 |
| 3,378,484 | 4/1968 | Ferrara | 208/191 |
| 3,409,691 | 11/1968 | Small | 260/676 |
| 3,438,892 | 4/1969 | Wymore et al. | 208/188 |
| 3,542,669 | 11/1970 | DeFeo | 208/91 |
| 3,620,969 | 11/1971 | Turnock et al. | 208/245 |
| 3,751,507 | 8/1973 | Walker | 260/674 |
| 3,755,152 | 8/1973 | Gulick | 208/307 |
| 3,830,730 | 8/1974 | Mead et al. | 208/144 |
| 3,919,078 | 11/1975 | Cohen et al. | 208/313 |
| 4,046,590 | 9/1977 | Riffer | 127/46.2 |
| 4,152,249 | 5/1979 | Avrillon et al. | 208/212 |
| 4,600,502 | 7/1986 | Butler et al. | 208/284 |
| 4,743,387 | 5/1988 | Frangatos et al. | 252/51.5 |
| 4,831,160 | 5/1989 | Leighton | 548/555 |
| 4,846,962 | 7/1989 | Yao | 208/301 |

FOREIGN PATENT DOCUMENTS

| | | | |
|---|---|---|---|
| 1050637 | 3/1986 | Japan | 210/689 |
| 826144 | 12/1959 | United Kingdom | C02B C11B |
| 1136463 | 12/1968 | United Kingdom | C10G 21/28 |
| 1168027 | 10/1969 | United Kingdom | C10G 25/12 |
| 2005299 | 4/1979 | United Kingdom | C10G 25/00 |

*Primary Examiner*—Mark L. Bell
*Assistant Examiner*—Patricia L. Hailey
*Attorney, Agent, or Firm*—Joseph J. Allocca

[57] ABSTRACT

Lube oil basestocks having an oil/water interfacial tension ($\gamma$ o/w) of less than 41 mN/m, preferably less than about 35 mN/m which exhibit unacceptable demulsibility can have their demulsibility performance improved by contacting said lube oil basestock with an acidic ion exchange resin, such as Amberlyst AR-15, or with silica. The treated lube oil base stock exhibits an oil/water interfacial tension ($\gamma$ o/w) of at least about 41 mN/m, preferably at least about 42 mN/m.

7 Claims, No Drawings

METHOD FOR IMPROVING THE DEMULSIBILITY OF BASE OILS

BACKGROUND OF THE INVENTION

In the course of processing, handling, storage, or use, lube oil basestocks, can pick up a not-insignificant quantity of water. For the purposes of this specification and the appended claims, lube oil base stocks are to be understood as being lube oil stocks which have been solvent extracted and/or dewaxed and/or hydrotreated.

The presence of water introduces a performance concern in the use of the oil. A major performance requirement of circulating oil (which is the usual mode of performance of a lube oil) is that the oil possess good demulsibility. By demulsibility is meant the ability of the base oil to separate from water after the water and oil have been intimately contacted and agitated. Water contamination and entrainment (evidenced by poor demulsibility) results in an impaired oil flow and impaired lubricity. The addition of demulsifiers does not always improve demulsibility performance. Furthermore, the addition of demulsifier additives increases costs.

SUMMARY OF THE INVENTION

The present invention is a method for improving the demulsibility performance of lube oil basestocks which comprises contacting a lube oil basestock feed exhibiting an oil/water interfacial tension of less than about 40 mN/m, preferably less than about 38 mN/m, most preferably less than about 35 mN/m with an acidic ion exchange resin or silica to increase the oil/water interfacial tension to at least 41 mN/m, preferably at least 42 mN/m.

DESCRIPTION OF THE PREFERRED EMBODIMENTS

A method is presented for improving the demulsibility performance of lube oil basestocks, which are defined as being oils which have been solvent extracted and/or dewaxed and/or hydrotreated, which method comprises contacting a lube oil base stock exhibiting an oil/water interfacial tension of less than about 40 mN/m, preferably less than about 38 mN/m, most preferably less than about 35 mN/m, with an acidic ion exchange resin or silica to increase the oil/water interfacial tension to at least 41 mN/m, preferably at least 42 mN/m. A lube oil base stock is defined as having poor demulsibility when under the ASTM D1401-84 demulsibility test more than 3 ml of emulsion is found to still be present after 15 minutes of standing time.

The lube oil base stock can be continuously contacted with the acidic ion exchange resin or silica adsorbent or it can be contacted with the acid ion exchange resin or silica adsorbent only when the measured oil/water interfacial tension ($\gamma$ o/w) is found to be below about 40 mN/m. Preferably, the lube oil base stock is contacted with the adsorbent only when needed; however, there are applications in which, due to the environment in which the oil is employed, it would be impractical or impossible to practice discontinuous contacting. Such applications, only by way of example and not limitation, would be lube oil in a circulating environment such as an internal combustion engine (spark or compression) or turbine engine. In such environments it is possible to pick up water in any number of ways. Further, by the very nature of the environment, oxidation or other degradations of the oil or accumulation of contaminants is highly probable. Thus, in the course of its use as a lubricant, a lube oil made from a base stock which originally exhibited good demulsibility can, over time, develop highly undesirable demulsibility characteristics. In such a circulating use environment the use of an adsorbent canister as a permanent fixture for continuous contacting in the lubricant circuit would be highly desirable.

The lube oil base stocks and lube oils treated by the present method are those which have been solvent extracted to remove aromatic hydrocarbons. Such solvent extraction processes are well known and need not be described in detail. They typically involve the counter current contacting of the lube oil stock with a selective extraction solvent such as N methyl pyrrolidone (NMP), furfural, phenol, sulfolane, $SO_2$ etc. to produce a dearomatized raffinate, This raffinate is then usually dewaxed to produce an oil having reduced cloud and pour points. Again, dewaxing processes are well documented and need not be described in detail. In general, dewaxing can be practiced employing either solvent dewaxing wherein the oil is mixed with a suitable solvent such as methyl ethyl ketone, methyl isobutyl ketone, toluene etc. and mixtures thereof and chilled to produce a wax slurry in oil which is filtered to produce a dewaxed oil, or else refrigerated solvent can be used in the first place. Such a system employing chilled solvent under agitated condition is described in U.S. Pat. No. 3,773,650 and U.S. Pat. No. 3,775,288. Autorefrigeration using autorefrigerative solvents such as propane can also be produced. In the above procedures wax is recovered as a by-product.

Alternatively, the oil can be catalytically dewaxed in which case the wax is converted to lower molecular weight hydrocarbons. This results in the loss of valuable hydrocarbon molecules.

As another alternative, the waxy oil can be subjected to hydroisomerization wherein the wax molecules are rearranged from their generally n-paraffin structure into multi-branch iso-paraffins which are good lube molecules of very low pour point.

Wax-isomerization can be practiced using the procedures of U.S. Pat. No. 4,992,159.

The dearomatized and/or dewaxed oil can be hydrotreated to reduce its organic nitrogen and/or sulfur content. Hydrotreating is practiced using any of the commercially available hydrotreating catalysts such as Co/Mo on alumina or Ni/Mo on alumina, e.g. HDN-30, KF840 etc. The procedure involves passing the oil over the catalyst, in the presence of hydrogen, at a temperature ranging between about 50° to about 500° C. and a pressure ranging between about 200 and about 4,000 psig. While hydrofining removes most of the polar surface active compounds which can cause poor demulsibility performance of base oils, and generally freshly hydrofinished base oils show good demulsibility performance, on occasion even hydrofinished oils exhibit poor demulsibility. This can also occur if hydrofinished oil is left in unprotected storage (i.e. stored under air) or if the oil picks up contaminants during handling, passage through various pipes, racks or non dedicated storage tanks.

In general the lube oil or lube oil base stock which exhibits undesirable demulsibility performance is one which has an oil/water interfacial tension ($\gamma$ o/w) of less than 40 mN/m, more usually less than 38 mN/m and even more typically less than 35 mN/m.

As previously stated, by undesirable demulsibility performance is meant that under ASTM D1401-84 demulsibility test conditions the oil exhibits 3 ml or more emulsion after standing for 15 minutes.

Adsorption is practiced using acidic ion exchange resin or silica. Acidic ion exchange resins include styrene-based polymers containing active sites in the form of sulfinic acid groups ($-SO^-H^+$). Amberlyst AR-15 is one such acid ion exchange resin.

Adsorption employs an adsorption zone suitably sized for the volume of lube oil to which it will be exposed and for the duration of such exposure.

The adsorption zone is maintained at a pressure ranging between 0 to 1000 psig, preferably 0.1 to 50 psig. The temperature is maintained within a range of about −20° to 200° C., preferably 10° to 100° C. Oil flow through the adsorption zone is maintained at between about 0.1 to 25 v/v/hr., preferably 1 to 10 v/v/hr.

The adsorption zone can be regenerated by passing an acidic solvent through it. In the case of a fixed installation, such as in a refinery, this can be done in place. In a circulating lubricant/lubricating environment such as in a reciprocating engine or turbine, the adsorption zone will be in the form of an adsorbent canister or filter which can be removed for replacement and/or regeneration away from the engine or turbine to prevent damage of the internal parts of the engine or turbine by the acidic regeneration solvent. Examples of such acidic solvent include: anhydrous acids, such as HCl. The adsorbed basic nitrogen molecules and other basic contaminants picked-up by the adsorbent would be replaced from the adsorbent by proton ($H^+$) from the acid and form salts which would be flushed out by the oil feed at the start of run.

EXAMPLES

According to those skilled in the art, the demulsibility performance of hydrocarbons is a function of viscosity. Higher viscosity base oils require more time for droplets of water to separate from emulsion. For good demulsibility performance as short a time as possible to separate the emulsion into water and base oil phase is required. Based on the literature, it would be expected that all low viscosity base oils should show good demulsibility performance.

A set of low viscosity conventional and non-conventional base oils was tested for demulsibility performance (Table 1). The results showed a good demulsibility performance in the case of slack wax isomerate (SWI) and MCT 10 base oils which require only 2 min. to separate water from oil/water emulsion. Marcol 172, a White oil, showed a degrading in demulsibility performance since it required 3 min. to separate the water, and Turbine 10 failed the test. The test used to measure the demulsibility performance of the oil is ASTM D1401-84. In this test 40 ml of distilled water is added to 40 ml of base oil in a 100 ml graduated cylinder. The water and oil are stirred using a paddle for 5 minutes at 54° C. The time required for the separation of the emulsion is recorded. Less than 3 ml of emulsion remaining in less than 15 minutes after termination of stirring is considered a "pass". These results clearly indicate that there are factors other than just viscosity which affect the demulsibility performance of base oils.

The oils which were so tested for demulsibility are described below in terms of their initial preparation:

Slack Wax Isomerate (SWI) is prepared from a slack wax which has been hydrotreated. The hydrotreated slack wax is then hydroisomerized, fractionated to remove a lube oil fraction, solvent dewaxed and hydrofinished.

150 N is an oil produced by phenol extraction of a lube stock, to produce a raffinate solvent dewaxing the raffinate and hydrofinishing the dewaxed raffinate.

Marcol 172 is a white oil produced by high pressure hydrogenation (2000 psi $H_2$) to saturate aromatics and totally remove sulfur and nitrogen species.

Turbine 10 is a severely NMP extracted oil which is then solvent dewaxed and hydrofinished.

TABLE 1

| Base Oils | Viscosity cSt/40° C. | Aromatics/ Polars Wt % | Sulphur ppm/wt % | Total Nitrogen ppm | ASTM D1401-84 Demulsibility Test Oil/Water/Emulsion (ml) | Time (min) | Test Result* Pass/Fail |
|---|---|---|---|---|---|---|---|
| SWI | 29.38 | <0.5 | <1 | <1 | 40/40/0 | 2 | Pass |
| 150 N | 29.48 | 16.1 | 0.09 | 8 | 40/40/0 | 2 | Pass |
| Marcol 172 | 32.71 | <0.5 | <1 | <1 | 40/40/0 | 3 | Pass |
| Turbine 10 | 29.71 | 14.0 | 0.06 | 36 | 41/25/14 | <60 | Fail |

*Less than 3 ml of emulsion in less than 15 min (Pass).

In order to identify the other factor or factors which effect demulsibility, the evaluation of demulsibility was repeated but at the constant time of 1 min., and the amount of emulsion versus the value of oil/water interfacial tension ($\gamma$ o/w) of each base oil was measured (Table 2).

TABLE 2

| Base Oils | Demulsibility Test Oil/Water/Emulsion (mL) | Test (min) | $\gamma$ o/w (mN/m) |
|---|---|---|---|
| SWI | 32/39/9 | 1 | 45.6 |
| MCT 10 | 41/28/12 | 1 | 43.1 |
| Marcol 172 | 24/39/17 | 1 | 39.0 |
| Turbine 10 | 3/0/77 | 1 | 33.4 |

The results showed that the amount of emulsion present after 1 min. of standing time directly correlates to the $\gamma$ o/w of base oils. Higher values of $\gamma$ o/w indicate that water can flocculate and coalesce faster. It is known that the value of $\gamma$ o/w can be drastically affected by the presence of ppm levels of surface active components present in base oils. These can be surface active sulphur and nitrogen molecules as well as surface active impurities such as residual solvents and oxidation by-products. Some base oils, due to prolonged storage, oxidize at room temperature and show a drastic degradation in demulsibility. It has been found that all oxidized base oils show a significant decrease in ($\gamma$ o/w) and, consequently, less water separated during demulsibility tests.

To improve the demulsibility performance of Turbine 10 base oil (Table 1), it was believed necessary to increase its $\gamma$ o/w to the level of at least about 41 mN/m to pass the ASTM demulsibility test. A process which would increase its γ o/w without introducing any new surface active compounds like residual solvents was needed. Adsorbents which leach surface active impurities, adsorbents which catalyze formation of surface active components in base oils, and adsorbents which require increased temperatures that might initiate the oxidation process needed to be avoided. The selected adsorbent was the ion-exchange resin Amberlyst AR-15. The base oil was passed through the adsorbent at room temperature in the presence of air. The value of γ o/w was increased from 33.4 to 42.0 mN/m, and as hoped the base oil showed an excellent demulsibility performance (Table 3). In order to evaluate the efficiency of Amberlyst AR-15 in removing the surface active components, a fresh batch of Turbine 10 was passed through another adsorbent, silica, which is capable of removing all aromatics/polars from the base oils to see if it was possible to obtain a γ o/w higher than 42.0 mN/m. After the total removal of nitrogen compounds to less than 1 ppm, sulphur to less than 2 ppm and aromatics/polars to less than 0.7 wt. %, the value of γ o/w did not increase any higher than 42.0 mN/m, thus indicating that Amberlyst AR-15 removed all surface active components of base oils which affect γ o/w. The removal of 100% of basic nitrogen indicates that Turbine 10 would also show an improvement in oxidation stability.

TABLE 3

| | | | | Turbine 10 (feed) | | | | |
|---|---|---|---|---|---|---|---|---|
| Adsorbents | Aromatics Polars Wt % | Sulphur ppm/Wt % | Total Nitrogen (ppm) | Basic Nitrogen (ppm) | γ o/w (mN/m) | Demulsibility Oil/Water/Emulsion (mL) | Test Time (min) | Test Result |
| None | 14.0 | 0.06 | 36 | 33 | 33.4 | 41/25/14 | (60) | Fail |
| Amberlyst AR-15 | 14.7 | 0.06 | 1.6 | 0 | 42.0 | 40/41/0 | (5) | Pass |
| Silica | 0.7 | 2 ppm | <1 | 0 | 42.0 | 40/40/0 | (5) | Pass |

The same experimental work was repeated with high viscosity base oil 1200 N which had failed the demulsibility test. After passing it through Amberlyst AR-15 the value of γ o/w was increased from 40.8 to 44.3 mN/m, and a significant improvement in demulsibility was observed (Table 4). The efficiency of Amberlyst AR-15 was evaluated by passing 1200 N base oil through silica. The value of γ o/w of 1200 N base oil after the silica removal of aromatics/polars to less than 1.7 wt. % was 44.4 mN/m, thus clearly indicating that Amberlyst AR-15 effectively removed all surface active components of 1200 N base oil and thus improved its demulsibility and oxidation stability.

TABLE 4

| | | | | 1200 N (Feed) | | | | |
|---|---|---|---|---|---|---|---|---|
| Adsorbents | Aromatics Polars Wt % | Sulphur ppm/Wt % | Total Nitrogen (ppm) | Basic Nitrogen (ppm) | γ o/w (mN/m) | Demulsibility Oil/Water/Emulsion (mL) | Test Time (min) | Test Result |
| None | 28.2 | 0.19 | 141 | 51 | 40.8 | 44/36/2 | (45) | Fail |
| Amberlyst AR-15 | 28.7 | 0.18 | 75 | 0 | 44.3 | 41/38/2 | (15) | Pass |
| Silica | 1.7 | 37 ppm | <1 | 0 | 44.4 | 40/40/0 | (5) | Pass |

The results in Table 4 show that in the case of 1200 N base oil, Amberlyst AR-15 also removed 0.01 wt. % of surface active sulphur compounds. After being passed through silica the base oil shows further improvement in demulsibility when compared to 1200 N base oil passed through Amberlyst AR-15 despite having the same value of γ o/w. This improvement is attributed to the lower viscosity of 1200 N due to removal of aromatics and polars by the silica.

In this process, the main component of surface active content, basic nitrogen, is totally removed to the levels of less than 1 ppm, thus an improvement in oxidation stability is also expected.

Other oil samples were tested to determine the effect of the present process on improving their demulsibility performance.

Two SWI samples were evaluated; SWI-1 had a o/w of 24.4 mN/m which after treatment was improved to 46.8 mN/m, the other SWI (from Table 1) had a o/w of 45.6 mN/m which after treatment was improved to 48.1 mN/m. These two SWI samples are presented in Table 5.

SWI-1 and SWI differ in the way in which they have been processed. SWI was produced using 2 stage hydroisomerization, a first stage employing standard isomerization conditions and a second stage employing mild conditions to remove aromatics and polars to less than 0.5 wt. %. This procedure is described and claimed in copending application U.S. Ser. No. 283,659, filed Dec. 13, 1988 now U.S. Pat. No. 5,158,671 (see European patent application, publication #323724).

In Ser. No. 283,659 a slack wax is first isomerized over an isomerization catalyst, preferably a Group VIII metal on halogenated refractory metal oxide support catalyst (e.g. Pt on $F/Al_2O_3$) at isomerization condition of 270°–400° C., 500 to 3000 psi $H_2$, hydrogen gas rates of 1000 to 10,000 SCF $H_2$/bbl and 0.1 to 10 v/v/hr. The total liquid product from this first isomerization zone is then treated in a second zone over the same or different isomerization catalyst under mild conditions of 170°–270° C., 300 to 1500 psi $H_2$, 500–10,000 SCF $H_2$/bbl and 0.25 to 10 v/v/hr. The effluent is then fractionated and dewaxed to yield a base oil exhibiting a high level of daylight stability and oxidation stability.

In the present case the SWI was subjected to an additional hydrofinishing step to remove additional polar type contaminants.

SWI-1 was produced using a single stage isomerization process and was not hydrofined. This explains the differences in their specification.

The decrease in time for SWI from 2 minutes to 1 minute can be explained by the removal of oxidized by-products from the oil sample. At the present time there is no procedure for testing for the oxygen components of base oils.

TABLE 5

| Adsorbents | Aromatics Polars Wt % | Sulphur ppm/Wt % | Total Nitrogen (ppm) | Basic Nitrogen (ppm) | γ o/w (mN/m) | Demulsibility Oil/Water/Emulsion (mL) | Test Time (min) | Test Result |
|---|---|---|---|---|---|---|---|---|
| | SWI (feed) | | | | | | | |
| SWI-1/None | 1.4 | 6 | <1 | 0 | 24.4 | 40/38/2 | 4 | Pass |
| Amberlyst AR-15 | 1.3 | 6 | <1 | 0 | 46.8 | 40/40/0 | 1 | Pass |
| SWI/None | <0.5 | <1 | <1 | 0 | 45.6 | 40/40/0 | 2 | Pass |
| Amberlyst AR-15 | <0.5 | <1 | <1 | 0 | 48.1 | 40/40/0 | 1 | Pass |

In order to evaluate the applicability of this procedure to different viscosity grades another sample of (600 N) grade base oil was tested. The selected sample of 600 N (NMP extracted/dewaxed/hydrofinished) had good demulsibility before being subjected to the present process. It was found that its demulsibility performance could be marginally improved, see Table 6.

TABLE 6

| Adsorbents | Aromatics Polars Wt % | Sulphur ppm/Wt % | Total Nitrogen (ppm) | Basic Nitrogen (ppm) | γ o/w (mN/m) | Demulsibility Oil/Water/Emulsion (mL) | Test Time (min) | Test Result Pass/Fail |
|---|---|---|---|---|---|---|---|---|
| | 600 N (feed) | | | | | | | |
| None | 19.6 | 0.12 | 100 | 88 | 39.4 | 39/40/1 | 5 | Pass |
| Amberlyst AR-15 | 19.6 | 0.12 | 10 | 0 | 42.4 | 40/40/0 | 5 | Pass |

What is claimed is:

1. A method for improving the demulsibility performance of lube oil basestocks comprising contacting a lube oil base-stock feed exhibiting an oil/water interfacial tension of less than about 40 mN/m with an acidic ion exchange resin or silica adsorbent to produce a lube oil basestock having an oil/water interfacial tension of at least 41 mN/m, said contacting being conducted at a pressure ranging between 0 to 1000 psig, a temperature in the range of about −20° to 200° C. and a flow of about 0.1 to 25 v/v/hr.

2. The method of claim 1 wherein the lube oil base stock feed exhibits an oil/water interfacial tension of less than about 38 mN/m.

3. The method of claim 2 wherein the lube oil base stock following the contacting step has an oil/water interfacial tension of at least 42 mN/m.

4. The method of claim 1 wherein the lube oil base stock following the contacting step has an oil/water interfacial tension of at least 42 mN/m.

5. The method of claim 1 wherein the acidic ion exchange resin is a styrene-based polymer containing active sites in the form of sulfinic acid groups.

6. The method of claim 1, 2, 3, 4 or 5 wherein the contacting is on a continuous basis.

7. The method of claim 1, 2, 3, 4 or 5 wherein the acid ion exchange resin adsorbent is regenerated by washing with an anhydrous acidic solvent.

* * * * *